US006938998B2

(12) United States Patent
Morikoshi

(10) Patent No.: US 6,938,998 B2
(45) Date of Patent: Sep. 6, 2005

(54) LIQUID EJECTING DEVICE

(75) Inventor: Koji Morikoshi, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 153 days.

(21) Appl. No.: 10/420,922

(22) Filed: Apr. 23, 2003

(65) Prior Publication Data

US 2004/0085429 A1 May 6, 2004

(30) Foreign Application Priority Data

Apr. 23, 2002 (JP) ..... P2002-120155
Apr. 16, 2003 (JP) ..... P2003-111016

(51) Int. Cl.[7] ..... B41J 2/185; B41J 2/165
(52) U.S. Cl. ..... 347/90; 347/31
(58) Field of Search ..... 347/36, 89–91, 347/35, 31

(56) References Cited

U.S. PATENT DOCUMENTS 5,051,761 A * 9/1991 Fisher et al. ..... 347/30
5,189,442 A * 2/1993 Herbert ..... 347/2
5,216,442 A * 6/1993 Parks et al. ..... 346/134
5,821,968 A * 10/1998 Ohyama et al. ..... 347/104

FOREIGN PATENT DOCUMENTS

JP 11-254657 9/1999
JP 2001-301201 10/2001

* cited by examiner

*Primary Examiner*—Thinh Nguyen
(74) *Attorney, Agent, or Firm*—Sughrue Mion, PLLC

(57) ABSTRACT

A liquid ejecting device includes a liquid ejecting head for moving in a first direction and ejecting droplets, a fixation medium supply device for transporting a fixation medium in a second direction orthogonal to the first direction, a platen for supporting the fixation medium horizontally in the move range of the liquid ejecting head, and a liquid absorbing member for absorbing the droplets and being positioned so as to be opposed to a move path of the liquid ejecting head. A plurality of first through holes are formed in the liquid absorbing member so as to gather the droplets absorbed in the liquid absorbing member, and are placed in at least either of both end areas of the liquid absorbing member in the first direction.

10 Claims, 6 Drawing Sheets

LIQUID EJECTING DEVICE

BACKGROUND OF THE INVENTION

This invention relates to a fixation medium transport mechanism of a liquid ejecting device, and more particularly to a structure for receiving droplets ejected to the outside of a print area in the move range of a liquid ejecting head.

A liquid ejecting device is used as a record apparatus used with an image record apparatus, a color material ejecting apparatus used for manufacturing a color filter of a liquid crystal display, etc., an electrode material (conductive paste) ejecting apparatus used for electrode formation of an organic EL display, an FED (face light emitting display), etc., a bioorganic substance ejecting apparatus used for biochip manufacturing, a specimen ejecting apparatus as a precision pipet, etc. One form of liquid ejecting device will be discussed by taking an ink jet record apparatus as an example.

The ink jet record apparatus includes at least a platen for flattening a fixation medium in a move area of an ejecting head and the ejecting head mounted on a carriage for reciprocating in the width direction of the fixation medium. The ink jet record apparatus records data of an image, etc., while ejecting ink droplets from the ejecting head to the fixation medium supported on the platen. After terminating one-line recording, the ink jet record apparatus feeds paper a predetermined amount and then records data of the next line. The ink jet record apparatus repeats this operation sequence.

However, at printing, if an erroneous paper size is set or a fixation medium of a smaller size than print data is placed, or if so-called borderless printing of a little enlarging and recording print data is performed to print an image on the whole fixation medium, printing is also performed reaching the outside of the fixation medium and the platen is contaminated by ink. As a result, when the next fixation medium is placed, the back of the fixation medium is contaminated by ink deposited on the platen; this is a problem.

To solve such a problem, as disclosed in JP-A-2001-301201, a concave part is formed at a position extending off the surroundings of the fixation medium, of a fixation medium reception member for supporting the fixation medium and an ink absorbing member is housed in the concave part. Also, as disclosed in JP-A-11-254657, an ink absorbing member is placed at a position supporting a fixation medium and extending off one end of the fixation medium.

However, the former involves a problem of limitation on the amount of ink that can be stored in the concave part and the latter involves a problem of ink floating on the surface of the ink absorbing member and contaminating the back of the fixation medium if the absorption capacity of the ink absorbing member is degraded.

SUMMARY OF THE INVENTION

It is therefore an object of the invention to provide a liquid ejecting device including a paper feed mechanism that can reduce contamination caused by droplets as much as possible.

In order to achieve the above object, according to the present invention, there is provided a liquid ejecting device comprising:

a liquid ejecting head, moving in a first direction, and ejecting a liquid droplet;

a fixation medium feeder, transporting a fixation medium in a second direction perpendicular to the first direction;

a platen, supporting the fixation medium horizontally in a moving range of the liquid ejecting head; and a liquid absorbing member, absorbing the liquid droplet, and disposed so as to be opposite to a moving path of the liquid ejecting head, wherein a plurality of first through holes are formed in the liquid absorbing member so as to draw the liquid droplet absorbed in the liquid absorbing member into the first through holes; and wherein the first through holes are disposed on at least one of both edge regions of the liquid absorbing member in the first direction.

Preferably, the first through holes are disposed so as to be opposite to edge portion of a transport region of the fixation medium in the first direction.

Preferably, each of the first through holes has a diameter of 0.5 mm to 5.0 mm.

Preferably, at least one concave portion is disposed on an edge portion of the liquid absorbing member in the second direction. The concave portion holds the liquid droplet by a capillary attraction.

Here, it is preferable that, the concave portion is disposed so as to be opposite to an edge portion of the fixation medium in the second direction when the fixation medium is placed on the platen for being ejected the liquid droplet thereon.

Here, it is preferable that, the concave portion is extended in the first direction.

Here, it is preferable that, a plurality of the concave portions are arranged in the first direction.

Preferably, a second through hole is disposed on an edge portion of the liquid absorbing member in the second direction. The second through hole has a diameter smaller than each of the first through holes.

Here, it is preferable that, the second through hole is disposed so as to be opposite to an edge portion of the fixation medium in the second direction when the fixation medium is set on the platen for being ejected the liquid droplet thereon.

Here, it is preferable that, a plurality of the second through holes are arranged in the first direction.

The droplets ejected to the outside of the area of the fixation medium are absorbed in the liquid absorbing member and ooze from the first through holes formed in the liquid absorbing member and liquid on the surface of the liquid absorbing member is pulled into the first through hole by the surface tension and drops from the through hole by gravitation, so that liquid is rapidly removed from the surface of the liquid absorbing member and contamination of the fixation medium is prevented.

If the liquid absorbed in the liquid absorbing member hardens and expands, the expansion of the liquid absorbing member can be absorbed by the volumes of the first through holes and warpage or bend of the liquid absorbing member is prevented and contamination of the fixation medium can be prevented.

DETAILED DESCRIPTION OF THE PREFERRED EMBODIMENTS

Referring now to the accompanying drawings, there are shown preferred embodiments of the invention.

Figure 1:
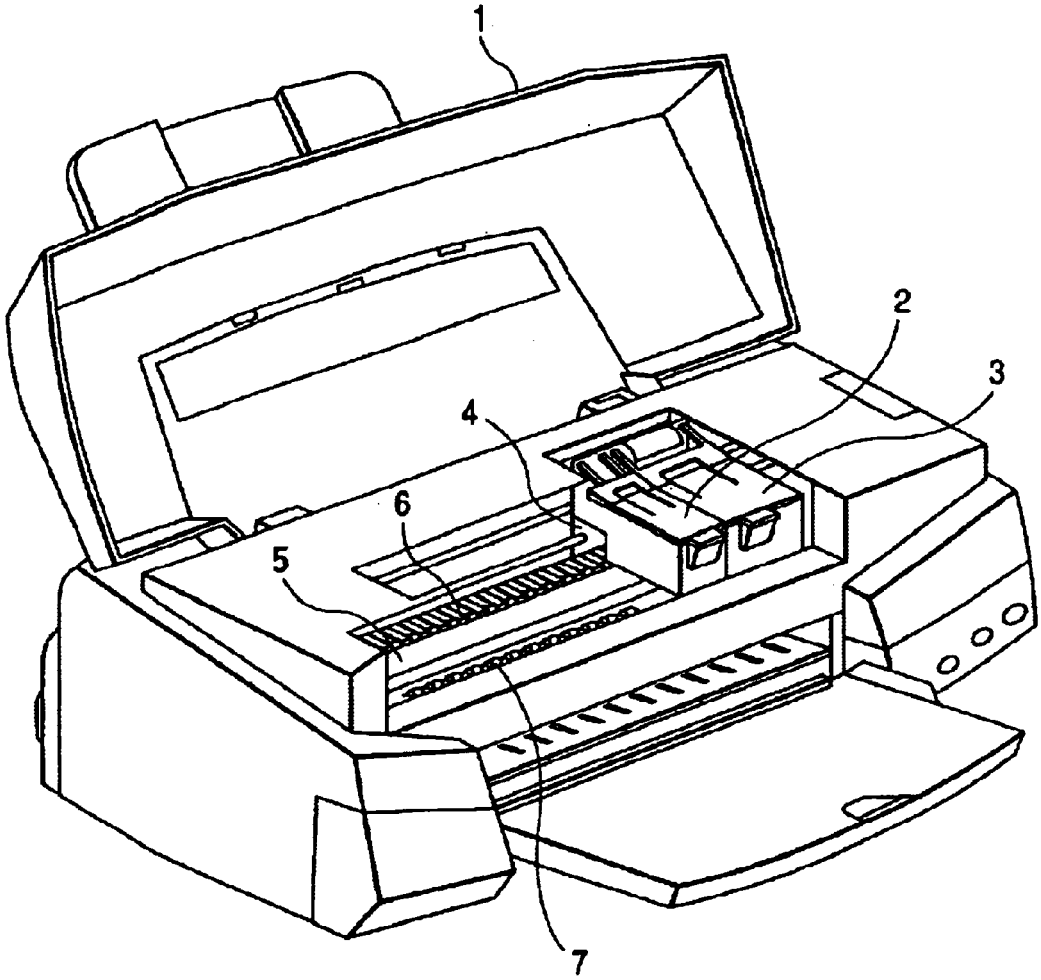
FIG. 1 is a perspective view to show one embodiment of an ink jet record apparatus incorporating an ink absorbing member of the invention.

FIG. 1 shows one embodiment of an ink jet record apparatus incorporating an ink absorbing member of the invention; it shows a print mechanism section with a case cover 1 opened. A platen 5 is placed at a position opposed to a move path of a carriage 4 with ink cartridges 2 and 3 mounted on the top of the carriage 4 and an ejecting head 8 mounted on the bottom (see FIG. 3A), and a first paper press roller 6 and a second paper press roller 7 are placed upstream in the discharge direction of a fixation medium so as to sandwich the platen 5 between the rollers 6 and 7.

Figure 2:
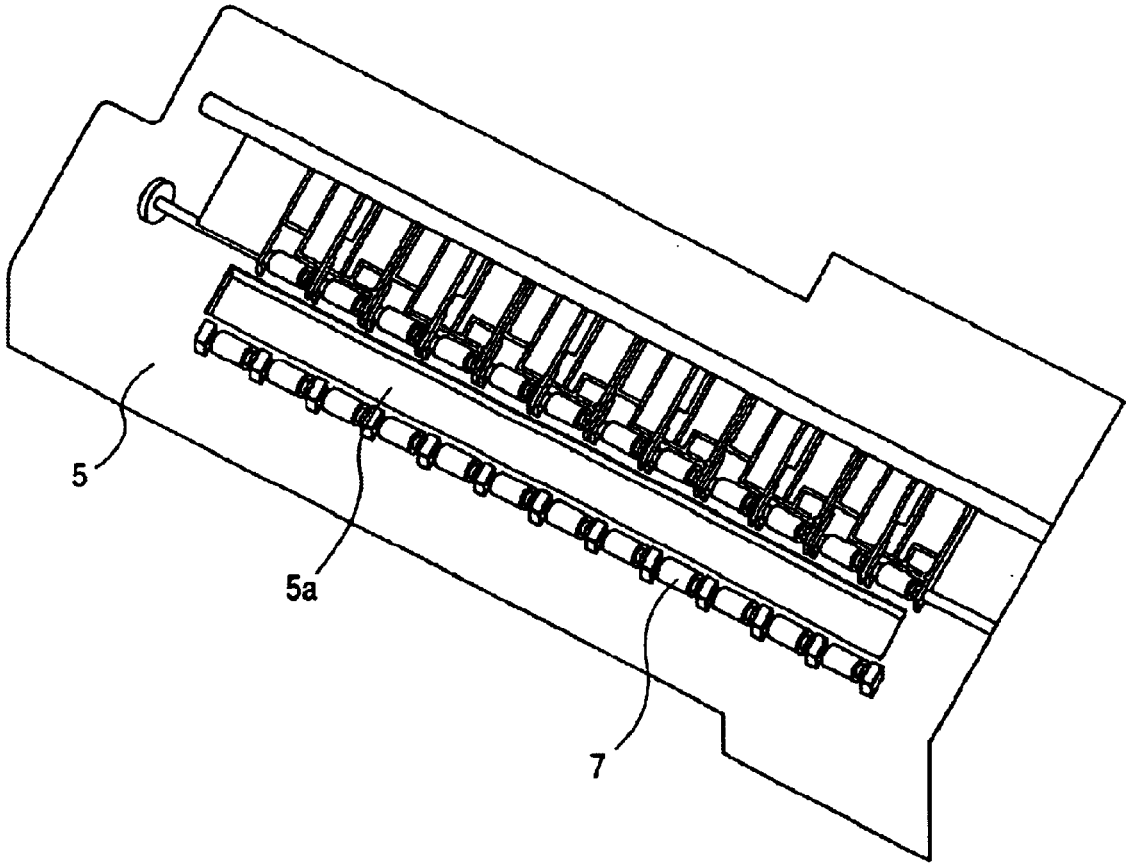
FIG. 2 is a drawing to show the top structure in the proximity of a paper feed mechanism of the record apparatus.

In the area where the fixation medium passes through, the platen 5 is formed with a rectangular window 5*a* reaching an outside area of the fixation medium having the maximum width printable, as shown in FIG. 2. Here, an ink absorbing member 10 of a feature of the invention is placed.

Figure 3A:
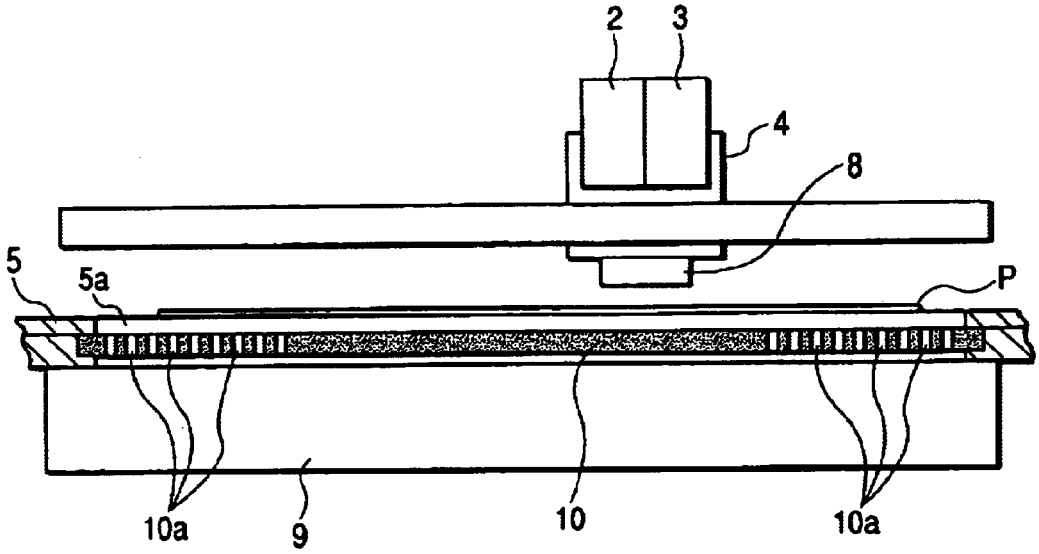
FIGS. 3A and 3B are a sectional view to show the structure in the proximity of a platen of the record apparatus of the invention and a top view of the ink absorbing member.
Figure 3B:
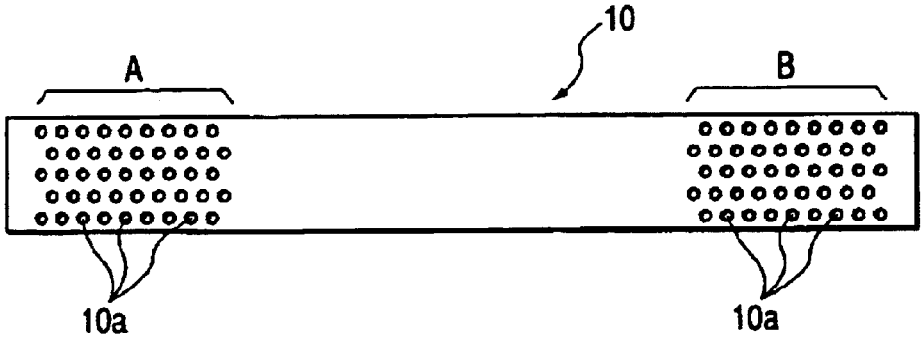

The ink absorbing member 10 is implemented as a material having a high absorption characteristic of an ink solvent, for example, a felt material or a hydrophilic polymeric porous sheet, and through holes 10*a* penetrating the ink absorbing member 10 to the back thereof are formed in areas A and B on the end sides of the fixation medium as shown in FIGS. 3A and 3B.

Each through hole 10*a* has a diameter of 0.5 mm to 5.0 mm to allow ink absorbed in the ink absorbing member 10 to flow into through osmosis. If the diameter is smaller than 0.5 mm, the capillary attraction is too strong and it is impossible to drop ink downward under its own weight. If the diameter is larger than 5.0 mm, it becomes impossible to retain ink in the through hole 10*a* and attract surface ink by the surface tension.

In the embodiment, when a fixation medium P is placed and borderless printing is started, as shown in FIG. 3A, ink droplets are ejected from the ejecting head 8 in response to print data and dots corresponding to the print data are formed on the fixation medium P.

Figure 4A:
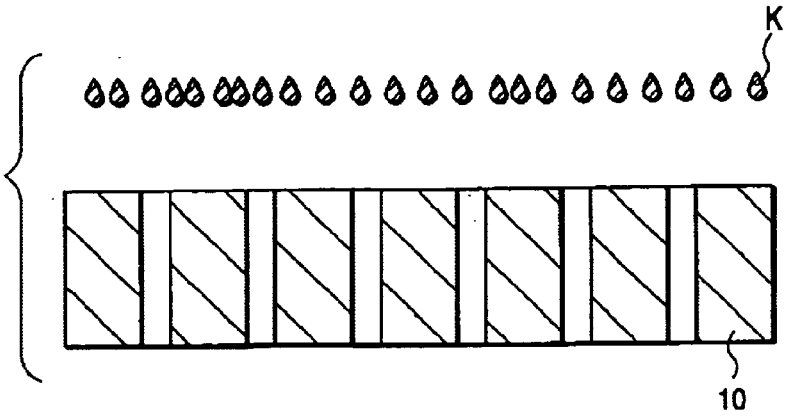
FIGS. 4A to 4D are drawings to schematically show the ink move process on the ink absorbing member.

By the way, ink droplets K from the ejecting head 8 are ejected outside the area of the fixation medium, namely, outside the tip side and both end sides of the fixation medium, the ink droplets K are hit on the portions of the ink absorbing member 10 exposed to the areas (FIG. 4A).

Figure 4B:
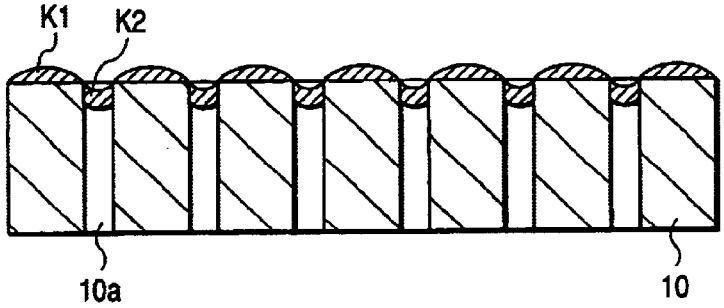

Of ink hit on the ink absorbing member 10, the ink discharged to the outside of the tip side of the fixation medium remains as an ink layer K1 on the surface of the ink absorbing member 10 and is absorbed by capillary attraction of the ink absorbing member 10 itself and penetrates into the through hole 10*a*and ink K2 gathers (FIG. 4B).

Figure 4C:
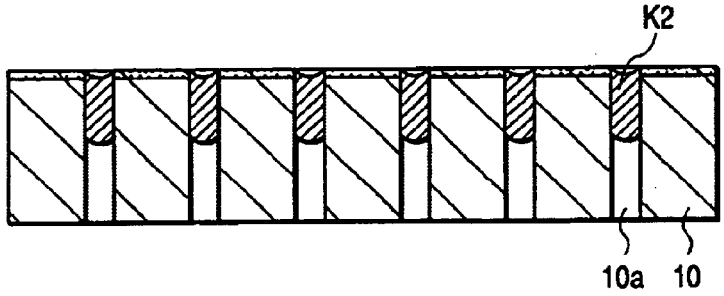
Figure 4D:
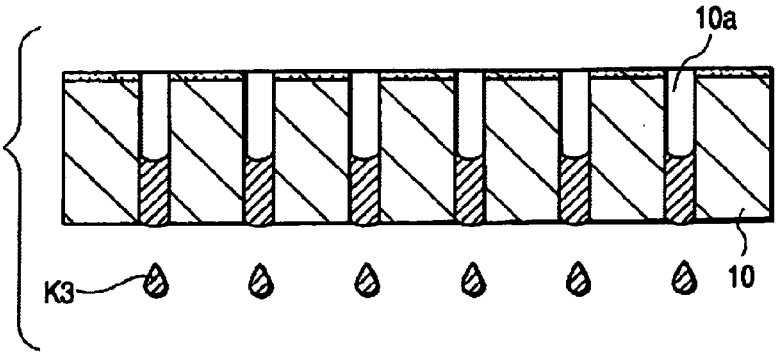

The ink K2 in the through hole 10*a* falls under its own weight and in the process, the surface ink layer K1 is pulled into the through hole 10*a* by the surface tension (FIG. 4C) and becomes ink droplet K3, which then drops from the lower end of the through hole 10*a* to a predetermined position, namely, a waste ink reservoir 9.

Accordingly, ink in the areas A and B on both end sides of the ink absorbing member 10 receiving new ink from the ejecting head 8 by printing each line is rapidly discharged from the surface of the ink absorbing member 10 into the waste ink reservoir 9 and ink does not float on the surface of the ink absorbing member 10 regardless of the print amount and contamination of the back of the fixation medium by ink can be prevented.

An ink absorbing member having higher ink holding power than the ink absorbing member 10 or a hardening accelerating agent is stored in the waste ink reservoir 9, whereby ink leakage as the record apparatus moves, etc., can be prevented.

By the way, ink in the end area in the paper feed direction, at the center of the ink absorbing member 10 receiving ink only at the print start time and the print termination time is small in amount and thus the ink solvent volatizes fast and in ink containing a solid component, the solid component is precipitated and projects from the surface of the ink absorbing member 10 and there is a fear of contaminating the back of the fixation medium.

Figure 5A:
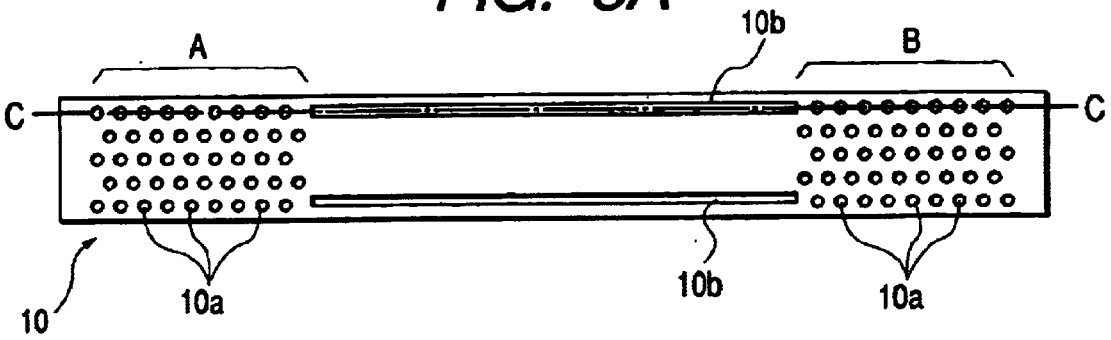
FIGS. 5A and 5B are a top view to show another embodiment of an ink absorbing member suited for the record apparatus of the invention and a sectional view taken on line C—C.
Figure 5B:
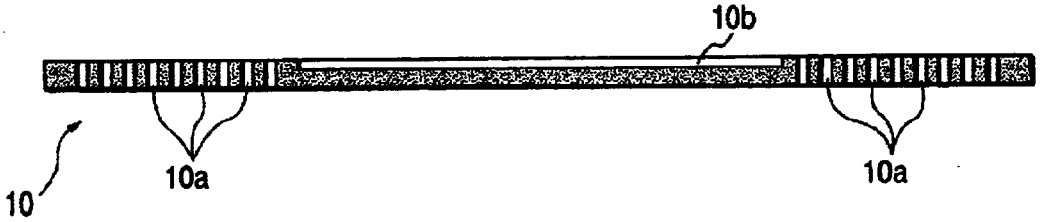

FIGS. 5A and 5B show an embodiment of an absorbing member suited for preventing contamination of the fixation medium caused by precipitation of the solid component of ink described above. In the embodiment, in areas A and B which become end sides of a fixation medium, groove-like closed-end concave parts 10*b* at the level of being capable of holding ink are formed on the top and the bottom in the move direction of the fixation medium in addition to through holes 10*a* penetrating the absorbing member to the back thereof.

According to the embodiment, ink in the area on the center side of the absorbing member 10 receiving ink only at the print start time and the print termination time is pulled to the closed-end concave part 10*b* through osmotic force although evaporation of ink solvent advances, so that the surroundings are kept in a wet state and hardening is prevented as much as possible. Accordingly, the solid component of ink is not precipitated and does not project from the surface of the ink absorbing member 10 and contamination of the back of the fixation medium can be prevented. In addition, ink can be distributed in the move direction of ejecting head, so that degradation of the ink absorption capacity at the end and rise in th concentration of the solid component can be prevented as much as possible.

Figure 6A:
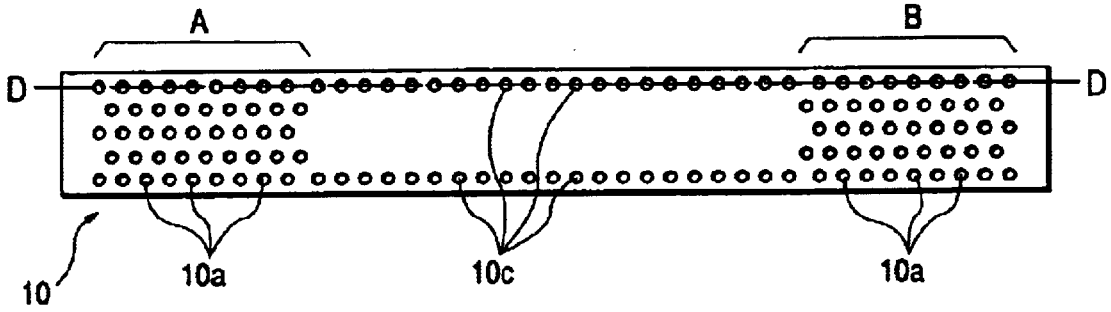
FIGS. 6A and 6B are a top view to show another embodiment of an ink absorbing member suited for the record apparatus of the invention and a sectional view taken on line D—D.
Figure 6B:
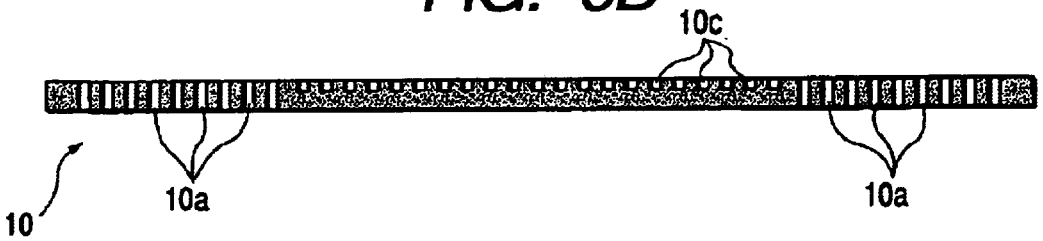

The elongated closed-end concave parts 10*b* are formed in the areas before and after the print area, but similar advantages are provided if a plurality of closed-end concave parts 10*c* of small size are formed like rows in end areas before and after in the move direction of a fixation medium, at the center of ink absorbing member 10, as shown in FIGS. 6A and 6B.

Figure 7A:
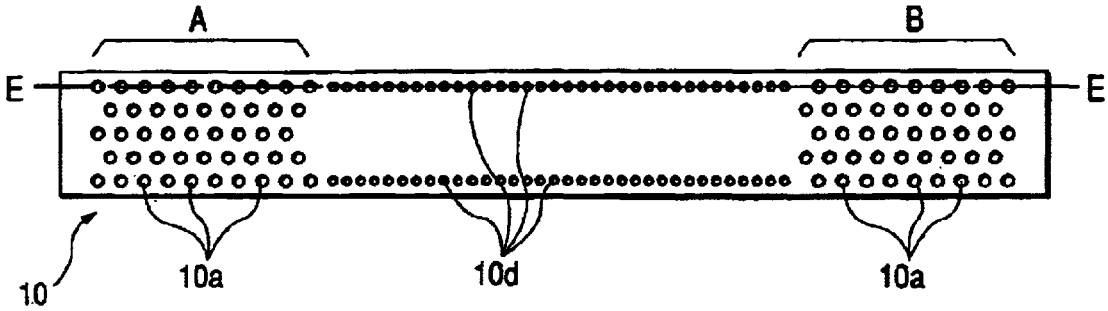
FIGS. 7A and 7B are a top view to show another embodiment of an ink absorbing member suited for the record apparatus of the invention and a sectional view taken on line E—E.
Figure 7B:
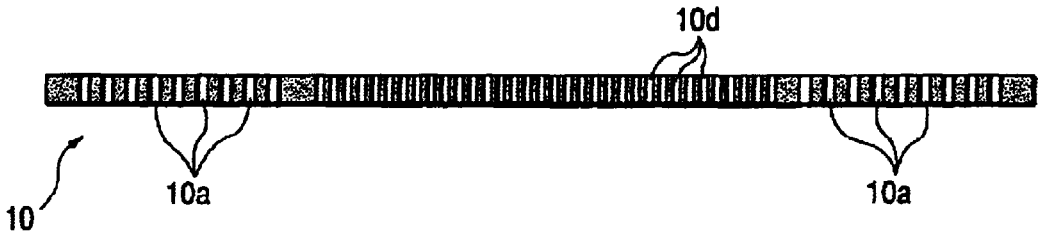

Further, if through holes 10*d* of smaller diameter than through holes 10*a* formed at ends in the width direction of a fixation medium are formed like rows in the areas before and after the print area in the move direction of the fixation medium as shown in FIGS. 7A and 7B, ink is held by capillary attraction of the through holes 10*d* for keeping the area in a wet state and if excessive ink is discharged, it can be discharged to a waste ink tank by gravitation.

What is claimed is:

1. A liquid ejecting device comprising:

a liquid ejecting head, moving in a first direction, and ejecting a liquid droplet;

a fixation medium feeder, transporting a fixation medium in a second direction perpendicular to the first direction;

a platen, supporting the fixation medium horizontally in a moving range of the liquid ejecting head; and a liquid absorbing member, absorbing the liquid droplet, and disposed so as to be opposite to a moving path of the liquid ejecting head, wherein a plurality of first through holes are formed in the liquid absorbing member so as to draw the liquid droplet absorbed in the liquid absorbing member into the first through holes; and wherein the first through holes are disposed on at least one of both edge regions of the liquid absorbing member in the first direction.

2. The liquid ejecting device as set forth in claim 1, wherein the first through holes are disposed so as to be opposite to edge portion of a transport region of the fixation medium in the first direction.

3. The liquid ejecting device as set forth in claim 1, wherein each of the first through holes has a diameter of 0.5 mm to 5.0 mm.

4. The liquid ejecting device as set forth in claim 1, wherein at least one concave portion is disposed on an edge portion of the liquid absorbing member in the second direction; and wherein the concave portion holds the liquid droplet by a capillary attraction.

5. The liquid ejecting device as set forth in claim 4, wherein the concave portion is disposed so as to be opposite to an edge portion of the fixation medium in the second direction when the fixation medium is placed on the platen for being ejected the liquid droplet thereon.

6. The liquid ejecting device as set forth in claim 4, wherein the concave portion is extended in the first direction.

7. The liquid ejecting device as set forth in claim 4, wherein a plurality of the concave portions are arranged in the first direction.

8. The liquid ejecting device as set forth in claim 7, wherein a plurality of the second through holes are arranged in the first direction.

9. The liquid ejecting device as set forth in claim 1, wherein a second through hole is disposed on an edge portion of the liquid absorbing member in the second direction; and wherein the second through hole has a diameter smaller than each of the first through holes.

10. The liquid ejecting device as set forth in claim 9, wherein the second through hole is disposed so as to be opposite to an edge portion of the fixation medium in the second direction when the fixation medium is set on the platen for being ejected the liquid droplet thereon.

* * * * *